US007490754B2

(12) United States Patent
Opferbeck

(10) Patent No.: US 7,490,754 B2
(45) Date of Patent: Feb. 17, 2009

(54) BOX PANEL WITH TEAR STRIP FOR OPENING

(75) Inventor: Kevin W. Opferbeck, Ashville, NY (US)

(73) Assignee: Bush Industries, Inc., Jamestown, NY (US)

( * ) Notice: Subject to any disclaimer, the term of this patent is extended or adjusted under 35 U.S.C. 154(b) by 0 days.

(21) Appl. No.: 11/830,517

(22) Filed: Jul. 30, 2007

(65) Prior Publication Data

US 2008/0029587 A1 Feb. 7, 2008

Related U.S. Application Data

(60) Provisional application No. 60/821,025, filed on Aug. 1, 2006.

(51) Int. Cl.
*B65D 17/32* (2006.01)
*B65D 17/50* (2006.01)

(52) U.S. Cl. ..... 229/240; 229/238; 229/239

(58) Field of Classification Search ..... 229/238, 229/239, 240, 243, 236
See application file for complete search history.

(56) References Cited

U.S. PATENT DOCUMENTS

| | | | | |
|---|---|---|---|---|
| 3,131,848 | A * | 5/1964 | Floyd | 229/117.16 |
| 3,355,089 | A * | 11/1967 | Champlin | 229/243 |
| 4,621,736 | A * | 11/1986 | Roccaforte | 229/101.1 |
| 5,307,986 | A * | 5/1994 | Schuster | 229/186 |
| 6,234,943 | B1 * | 5/2001 | Copin | 493/11 |
| 6,364,202 | B1 * | 4/2002 | Zelley | 229/236 |
| 6,913,189 | B2 * | 7/2005 | Oliff et al. | 229/120.011 |
| 6,945,450 | B2 * | 9/2005 | Rusnock | 229/243 |
| 7,163,139 | B2 * | 1/2007 | Marie et al. | 229/237 |

FOREIGN PATENT DOCUMENTS

| | | | |
|---|---|---|---|
| GB | 22354330 A | * | 3/1991 |
| JP | 5-32251 A | * | 2/1993 |

* cited by examiner

*Primary Examiner*—Gary E Elkins
(74) *Attorney, Agent, or Firm*—The Webb Law Firm

(57) ABSTRACT

A box is provided with a tearable panel and a tear strip along with perforated flaps, such that removal of the tear strip provides access to the perforated flaps, such that the perforated flaps may easily be torn to open the box.

14 Claims, 13 Drawing Sheets

BOX PANEL WITH TEAR STRIP FOR OPENING

CROSS-REFERENCE TO RELATED APPLICATION

This application claims the benefit of U.S. Provisional Application No. 60/821,025 filed Aug. 1, 2006.

BACKGROUND OF THE INVENTION

1. Field of the Invention

The subject invention is directed to a tear strip for opening a panel of a box and, more particularly, a tear strip with associated adjacent perforations by which the box panel may be opened relatively easily and quickly. The box, in accordance with the subject invention, is well suited for containing parts for ready-to-assemble furniture.

2. Description of Related Art

Many products are packaged and shipped in corrugated fiberboard boxes and these boxes must have the structural integrity to remain intact during shipping, but furthermore, have a reasonable means for opening when the box with the product has finally arrived at its destination. While for very lightweight products, the box may be relatively light and thin and taken apart with relative ease, heavier products require a larger more robust box. A typical box would be thicker and heavier and typically have overlapping panels that are well secured to one another. One such heavier product would be panels used in the construction of ready-to-assemble furniture. Common industry practice for securing overlapping panels may involve gluing such panels together or to staple such panels together, either alone or in combination with glue. However, opening such a box may be challenging and depending upon the approach utilized, may be dangerous. As an example, a box cutter knife may be utilized, however, awareness of the razor-sharp blade is imperative to avoid injuries and to avoid damaging the product contained therein. Certain pry tools may also be used to pry the glued or stapled flaps from one another, however, care must again be taken to avoid damaging the product contained therein. Finally, no matter what technique is utilized, time and patience is required to open such a box and, in the end, the box may end up totally destroyed such that residual contents of the box, such as packing material, must be placed in a separate container for disposal.

A design and method are needed to permit opening of a box in a simple efficient manner that, furthermore, may be "re-closed" to return the box to a generally closed appearance such that residual contents from unpacking the product may be retained within the generally closed box and the box efficiently disposed.

SUMMARY OF THE INVENTION

A box with a panel has tear tape along a length of the inside surface of the panel to assist in opening at least one tearable segment adjacent thereto. The box is made of material that is tearable at least along the tear strip, with or without perforations. In the fully assembled state, the panel portion along the tear tape has substantially full structural integrity. The adjacent tearable segments may have perforations along their tear lines or, in the alternative, may themselves have tear tape along the tear lines.

One embodiment is directed to a box with foldable flaps for easy opening. The box is comprised of a top panel, a bottom panel, and side panels connecting the top panel to the bottom panel. One of the top panel and bottom panel has a tear strip with a first end, a second end and opposing edges therebetween. The tear strip is secured to the panel and a first flap and a second flap are defined on opposing sides of the tear strip. Each of the first flap and the second flap has an outer edge connected to a side panel and an inner edge defined at an edge of the tear strip. Each flap has a pair of opposing lateral edges between the outer edge and the inner edge and each of the opposing lateral edges has perforations extending along substantially the entire length. Each perforation extends substantially through the thickness of the flap. Pulling the tear strip creates a gap between the first flap and the second flap and provides access for pulling the inner edges of the flaps such that the flap perforations may be torn along the perforations with relative ease to provide access to the interior of the box.

Another embodiment is directed to a method of opening a box having a top panel, a bottom panel, and side panels connecting the top panel to the bottom panel, wherein one of the top panel and bottom panel has a tear strip having a first end, a second end and opposing edges therebetween, wherein the tear strip is secured to the panel, a first flap and a second flap defined on opposing sides of the tear strip, and wherein each of the first flap and the second flap has an outer edge connected to a side panel and an inner edge defined at an edge of the tear strip, and wherein each flap has a pair of opposing lateral edges between the outer edge and the inner edge, wherein each of the opposing lateral edges has perforations extending along substantially the entire length and, wherein each perforation extends substantially through the thickness of the flap. The method comprises the steps of a) pulling the tear strip to creates a gap between the first flap and the second flap, b) pulling the inner edge of one flap to sever the flap along the perforation, and c) pulling the inner edge of the opposing flap the sever the flap along the perforation, thereby providing access to the interior of the box. The flaps may be folded to the closed position to provide a box that is capable of containing the packing from the originally packed box.

DETAILED DESCRIPTION OF THE INVENTION

Figure 1:
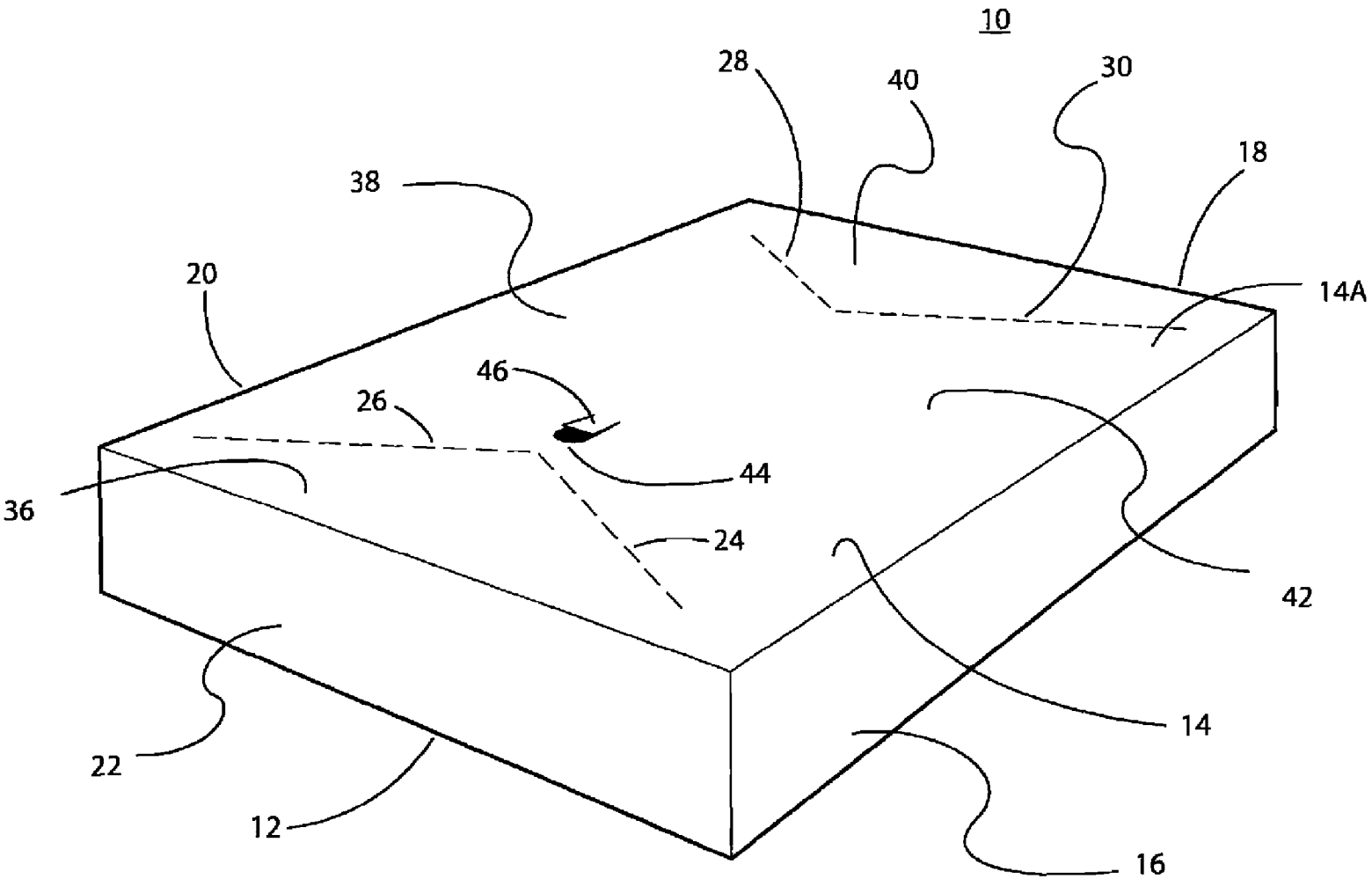
FIG. 1 is perspective exterior view of the box showing the bottom panel in accordance with the subject invention.
Figure 2:
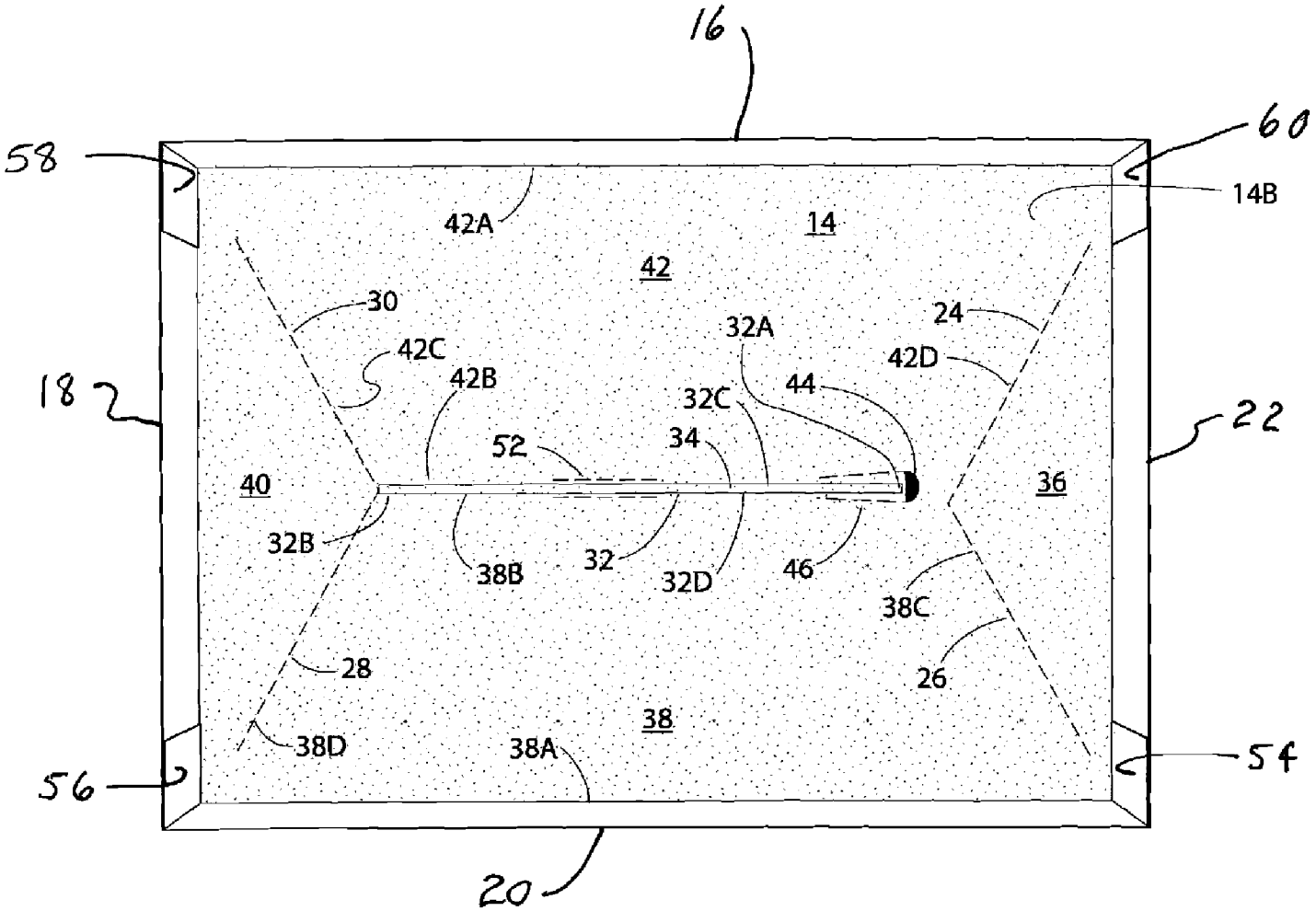
FIG. 2 is a top interior view of the bottom panel of the box with the top panel removed for clarity.
Figure 12:
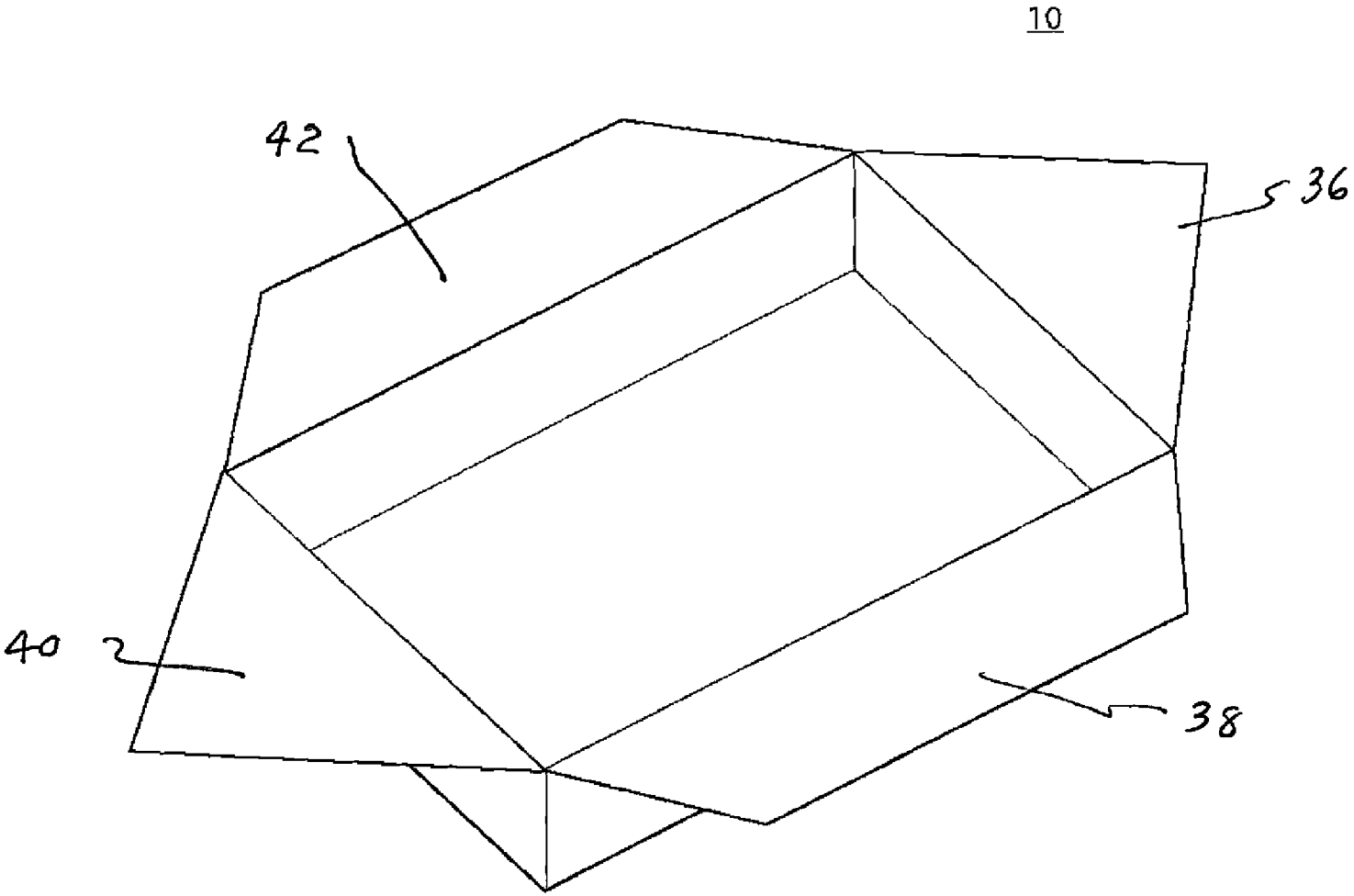
FIG. 12 is an isometric view of an open box.

FIG. 1 is a perspective view of a fully enclosed box 10. Such a box may be used to contain ready-to-assemble furniture parts which may include heavy panels. For purposes of illustration, the box is inverted such that it is comprised of a top panel 12, a bottom panel 14 and four side panels 16, 18, 20, 22 therebetween. The bottom panel 14 is a single-ply layer of corrugated fiberboard or other tearable material which, as will be described, is capable of being torn to an open pattern as illustrated in FIG. 12, in a relatively simple and efficient manner. Directing attention to FIGS. 1 and 2, FIG. 1 shows the exterior surface 14A of the bottom panel 14 while FIG. 2 shows the interior surface 14B of the bottom panel 14. The dashed lines identified as lines 24, 26, 28 and 30 represent perforations which extend through the entire thickness of the bottom panel 14. These perforations in conjunction with the tear strip 32 identified by the tear tape 34 outline four flaps 36, 38, 40, 42.

The tear strip 32 is a tensile member having a first end 32A, a second end 32B and two opposing edges 32C and 32D.

Flap 38 has an outer edge 38A connected to the side panel 20 and an inner edge 38B adjacent to the edge 32D of the tear strip 32. Flap 38 also has two lateral edges 38C, 38D.

Additionally, flap 42 has an outer edge 42A connected to the side panel 16 and an inner edge 42B adjacent to the edge 32C of the tear strip 32. Flap 42 also has two lateral edges 42C, 42D. It should be pointed out that the dashed lines in the figures throughout this application are included only as illustrative of the location of the perforations and the actual product may not have such dashed lines indicating perforations.

A finger hole 44 extends through the entire thickness of the bottom panel 14 to provide access to a cut-out starter tab 46 which provides access to the first end 32A of the tear strip 32. The tear strip 32 extends along substantially the entire length between perforated flap 36 and perforated flap 40, such that, when the tear strip 32 is grabbed and pulled from the exterior surface 14A of the bottom panel 14, the entire tear strip 32 is removed from the bottom panel, thereby leaving only the four perforations 24, 26, 28, 30 retaining the four flaps 36, 38, 40, 42 together. It is essential for the tear tape 34 of the tear strip 32 to be positioned on the interior surface 14B of the bottom panel 14, such that when the tear tape 34 is lifted from the exterior surface 14A of the bottom panel 14, the entire tear strip 32 is removed. If the tear tape 34 were on the exterior surface 14A of the bottom panel 14 it is possible that only the tear tape 34 would be removed, thereby leaving intact the tear strip 32 and the connection between flaps 38 and 42.

Figure 3:
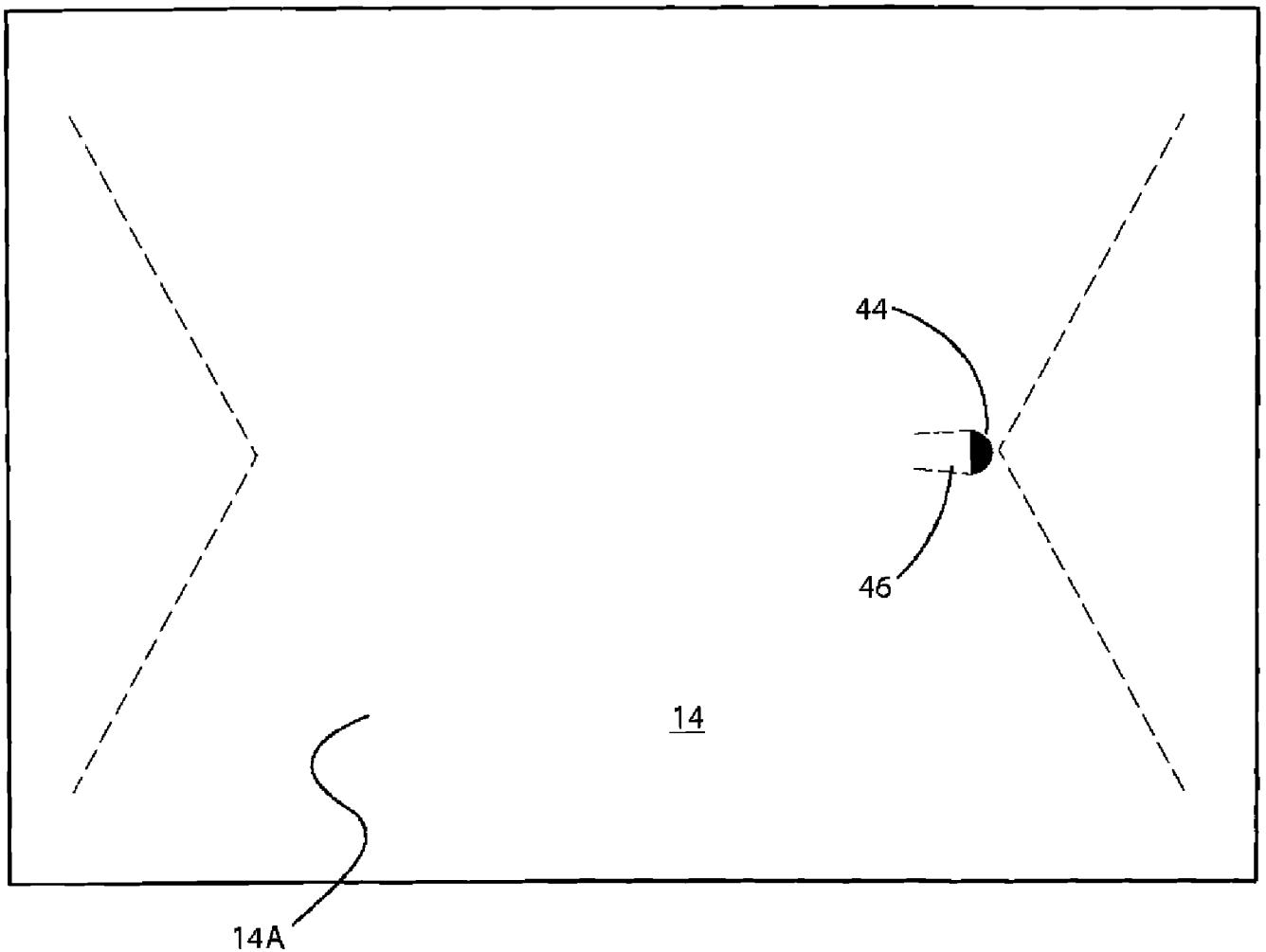
FIG. 3 is a bottom view of the bottom panel of the box.

FIG. 3 illustrates a view similar to FIG. 1 showing the exterior surface 14A of the bottom panel 14. It should be noted that the starter tab 46 is perforated through the entire thickness of the bottom panel 14. The remainder of the bottom panel 14 along the tear strip 32 remains substantially unperforated. A small segment of locating marks 52 (FIG. 2) may have a limited number of puncture marks showing where the tear tape 34 should be located. Very few or no puncture marks or perforations on the bottom panel 14 along the tear strip 32 is important because boxes designed to carry heavy loads must maintain their structural integrity and, although it may be easier to remove the tear strip 32 (better seen in FIG. 2) with perforations along this strip 32, the structural integrity, once that perforation is present, will be reduced. Therefore, by way of the current design, a substantial portion of the bottom panel 14 maintains the full un-perforated thickness of the corrugated fiberboard or other tearable material.

It should be noted that the width of the tear tape 34 must be great enough such that it may be grabbed by a user's finger to impart to the bottom panel 14 a substantial shear force to remove the tear strip 32, but the width of the tear tape 34 must not be so great as to distribute the force of the pull by the user over a greater area, thereby making removal of the tear strip 32 difficult.

Figure 4:
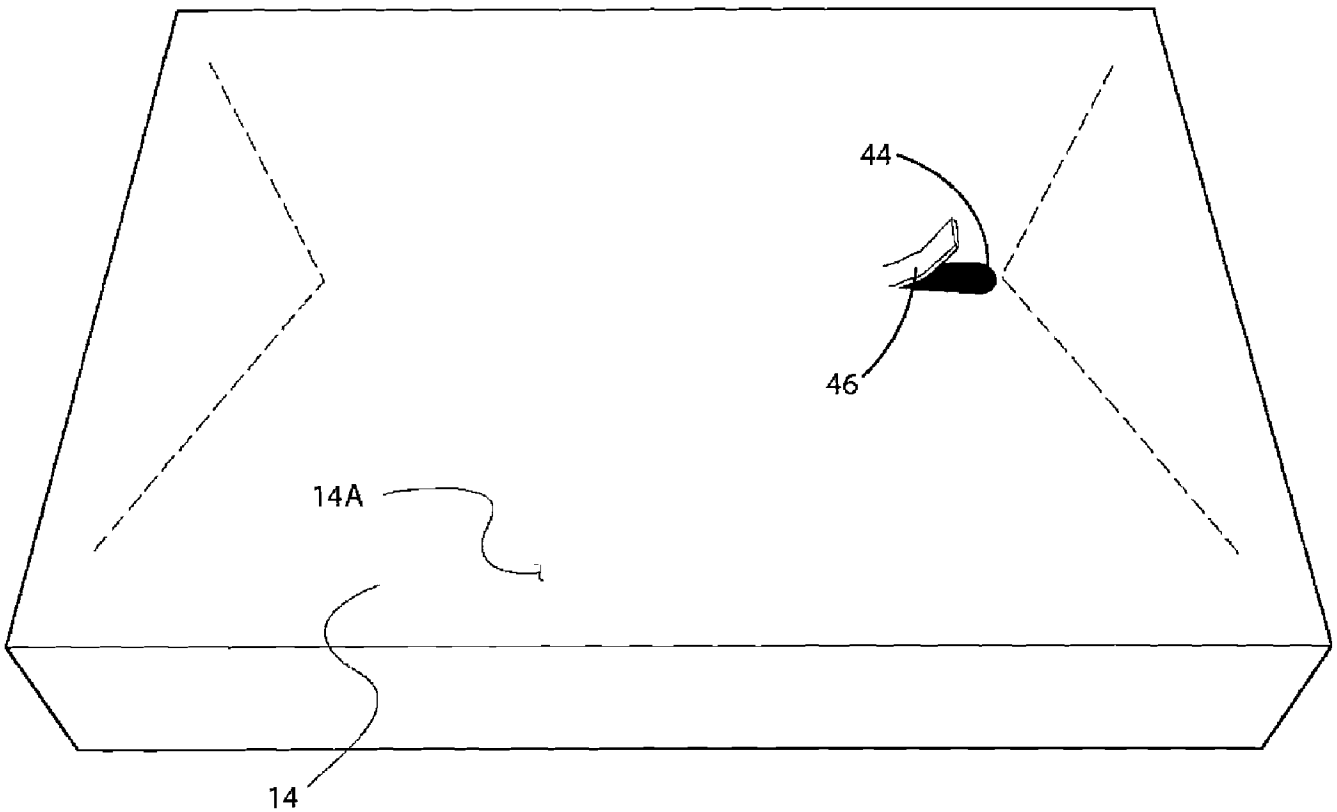
FIG. 4 is an exterior view of the bottom panel with the tear strip associated with the tear tape partially removed.

FIG. 4 illustrates an exterior view of the bottom panel 14 with the starter tab 46 pulled from the bottom panel 14. As previously mentioned, the starter tab 46 includes perforations extending therethrough for ease of removal. As seen in FIG. 2, the tear tape 34 extends onto the starter tab 46 so that when the starter tab 46 is pulled, the tear tape 34 is also pulled.

Figure 5:
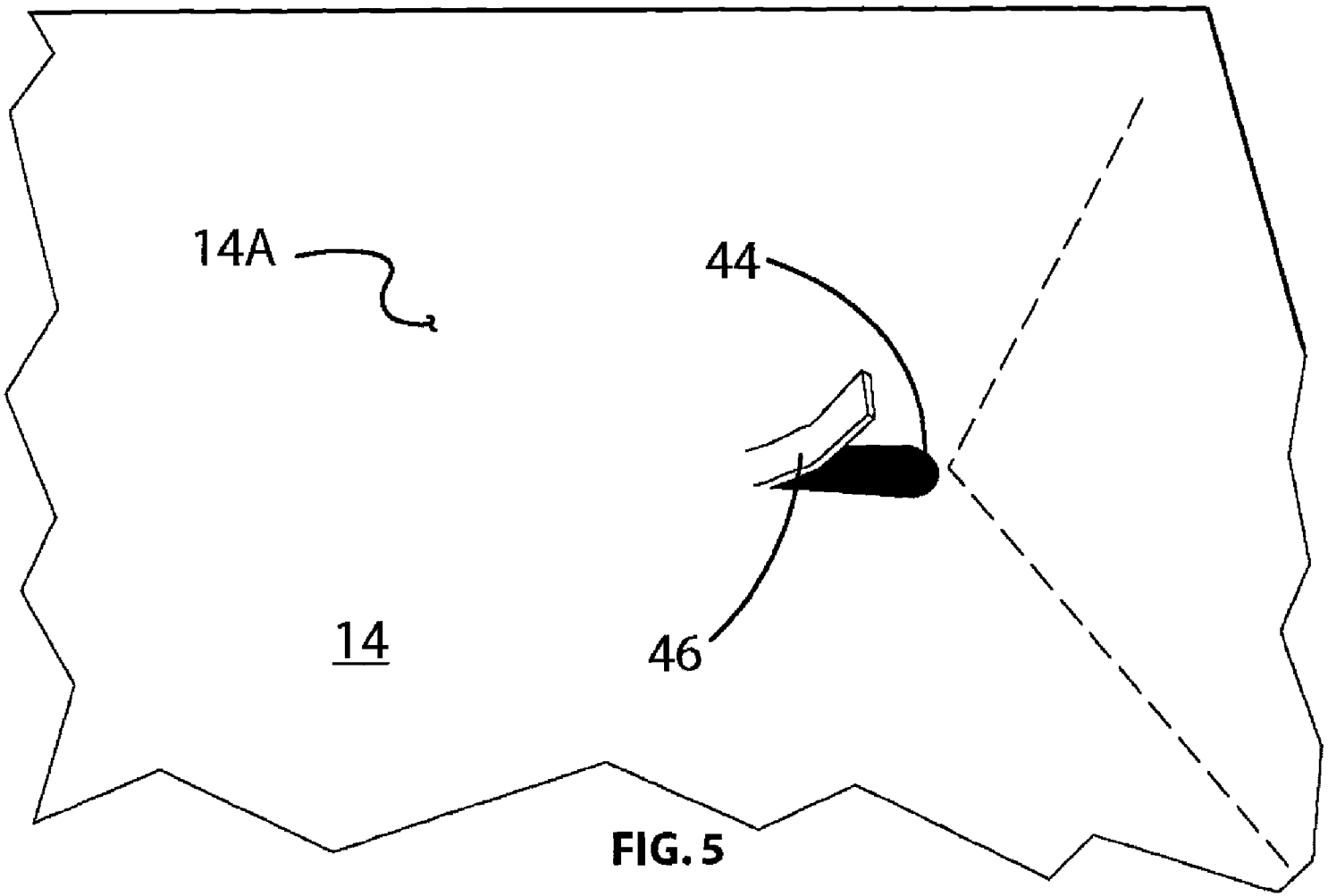
FIG. 5 is an enlarged view of the tear strip illustrated in FIG. 4.

FIG. 5 illustrates an enlarged detail of the finger hole 44 and starter tab 46 illustrated in FIG. 4.

Figure 6:
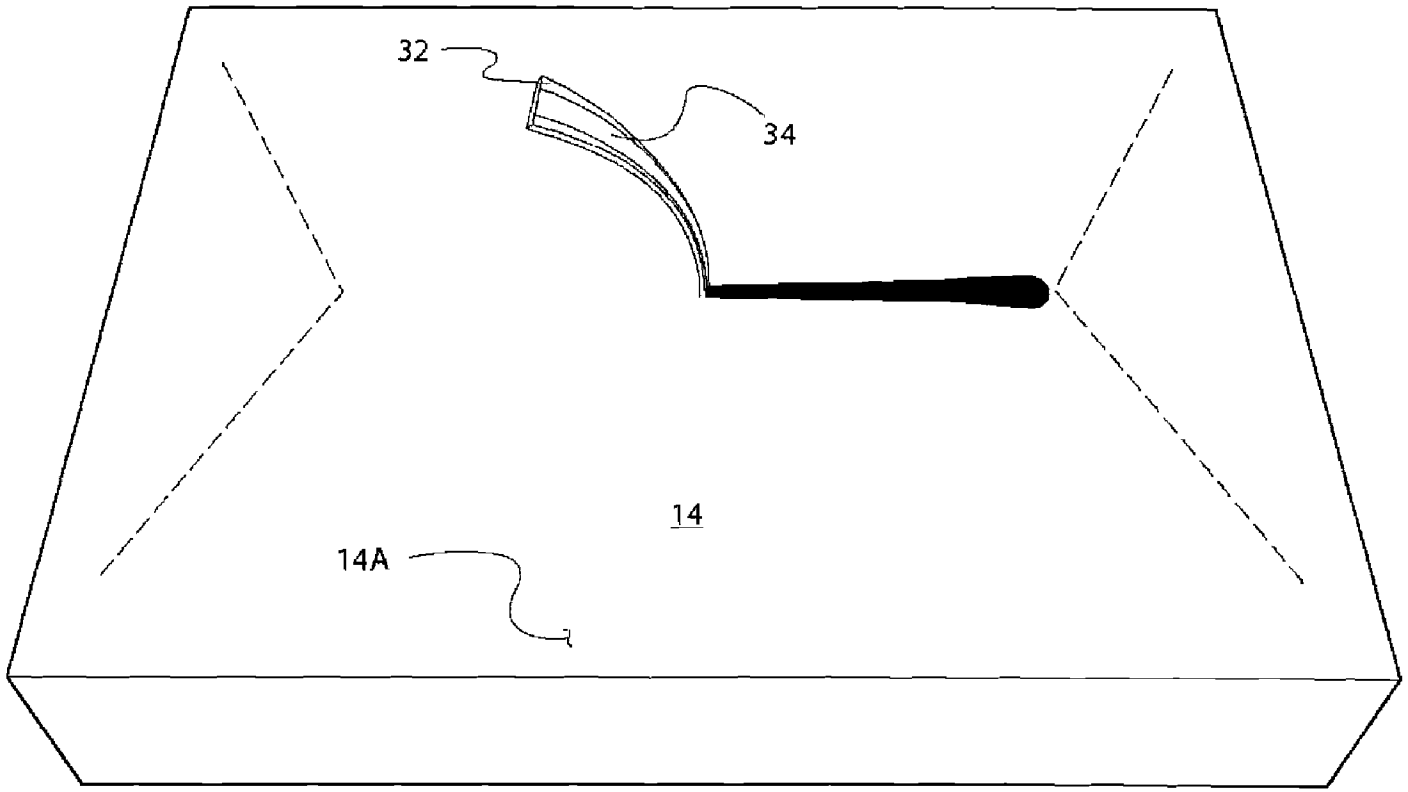
FIG. 6 is an exterior view of the bottom panel of the box with the tear strip further advanced.

FIG. 6 illustrates an exterior view of the bottom panel 14, wherein the tear tape 34 has been advanced to partially remove the tear strip 32.

Figure 7:
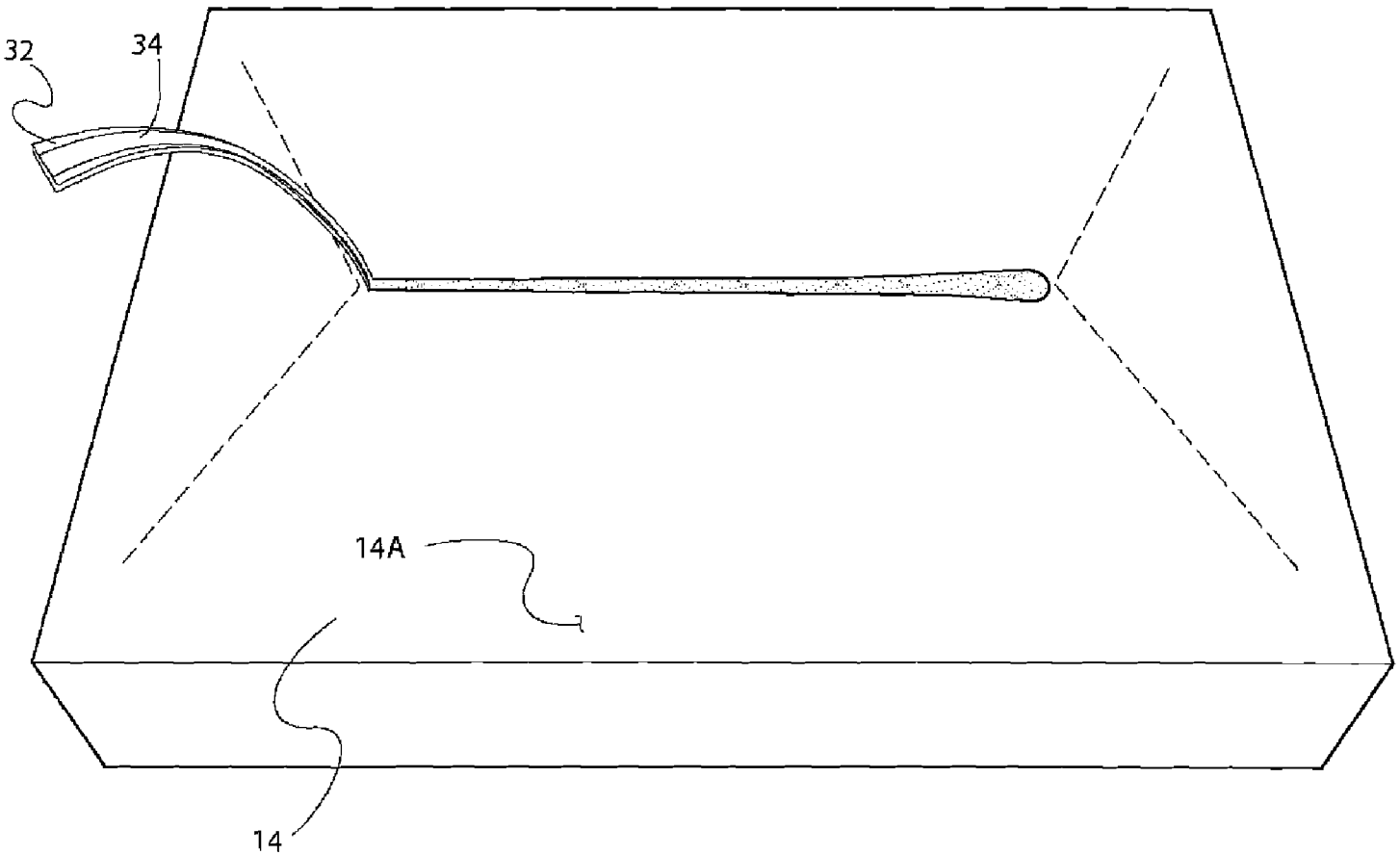
FIG. 7 is an exterior view of the bottom panel with the tear strip substantially advanced.

FIG. 7 illustrates an exterior view of the bottom panel 14, wherein the tear tape 34 has removed the tear strip 32 almost its entire length.

Figure 8:
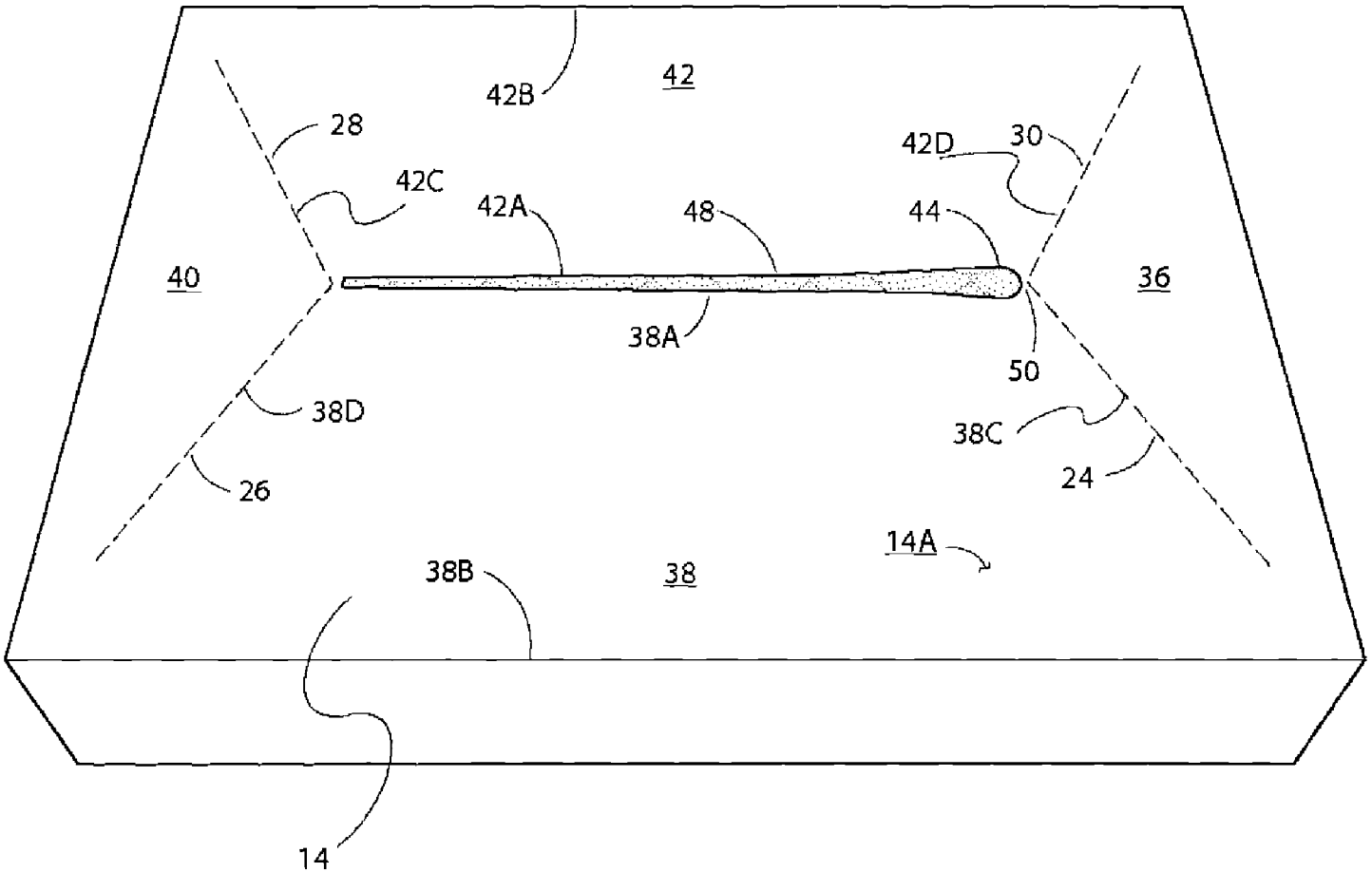
FIG. 8 is an exterior view of the bottom panel with the tear strip completely removed.
Figure 9:
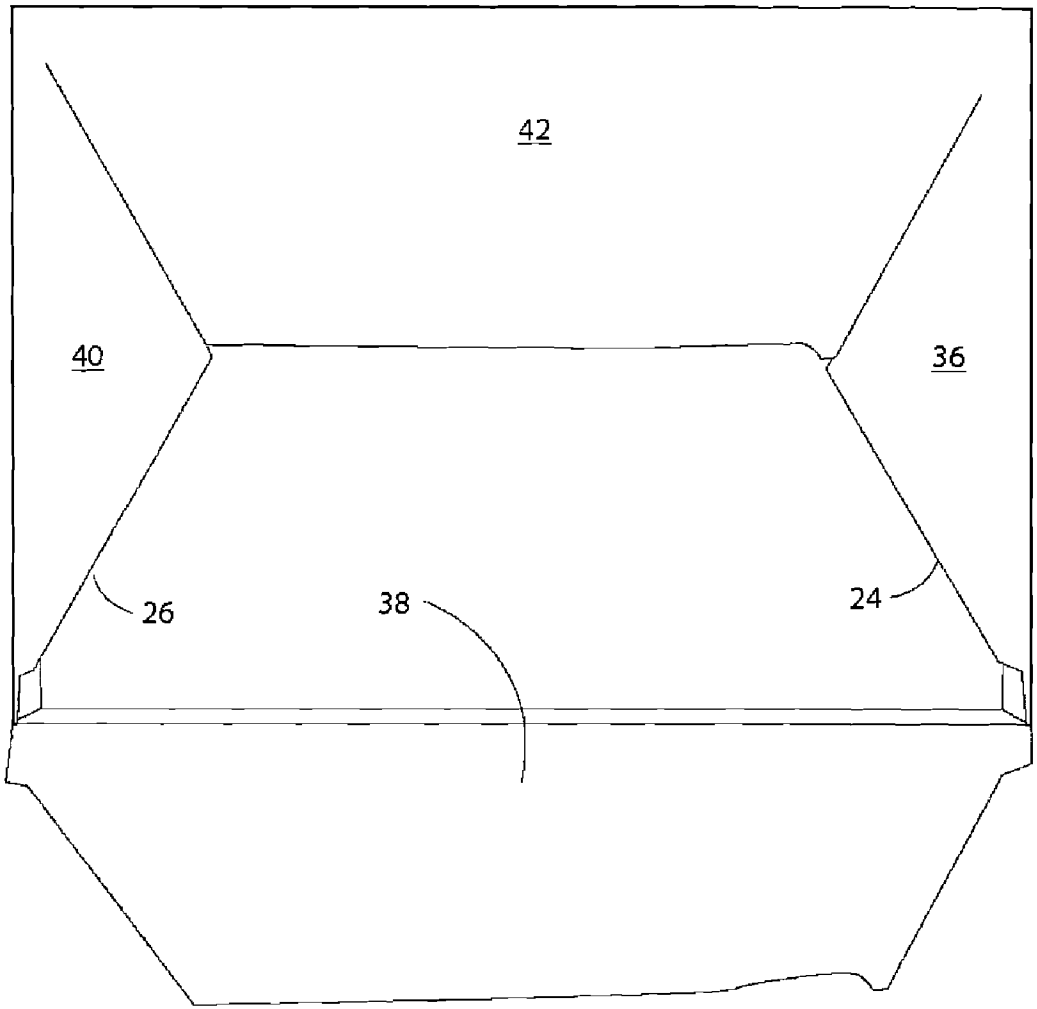
FIG. 9 is an exterior view of the bottom panel of the box with one flap open.

FIG. 8 shows the slot 48 created with the tear strip 32 (FIG. 7) removed. It should be noted in FIG. 8 that, but for a small portion 50 between the finger hole 44 and the flap 36, the four flaps 36, 38, 40, 42 are retained only by the perforations 24, 26, 28, 30. The finger hole 44 could also extend to or overlap with the perforations 24, 30. The slot 48 provides a sufficient opening for the user to extend one or more fingers to the interior side of the bottom panel 14 to grasp a flap 38, 42 and apply a force such that the flap 38 or 40 may be torn along the perforations. As an example, as illustrated in FIG. 9, flap 38 has been torn along the perforations 24, 26 and is shown in the open position.

Figure 10:
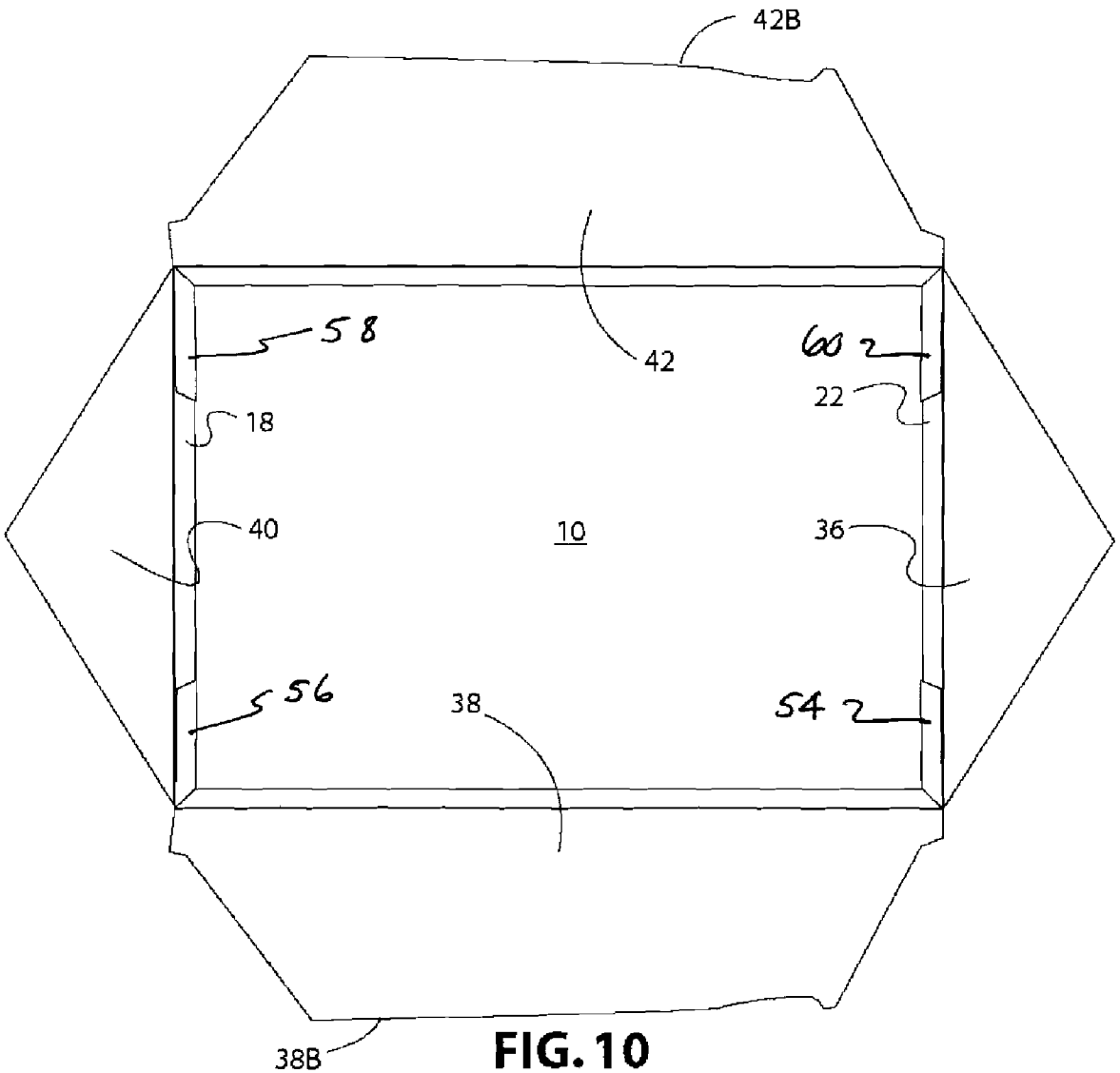
FIG. 10 is an exterior view of the bottom of the box with all of the flaps open.

Thereafter, the remaining flaps may be torn along the remaining perforations such that all of the flaps are open as illustrated in FIG. 10. In this fashion, any contents within the box 10 may be easily removed. By design, flaps 38, 42 may preferably be opened first and then flaps 36, 40 may be opened. The slot 48 and the perforations 24, 26, 28, 30 may be oriented differently and the preferred opening sequence of the flaps 36, 38 40, 42 may thereafter change.

It should be noted from inspection of FIG. 10 that the bottom panel is comprised of flaps 36, 38, 40, 42 and that each of these flaps is a single-ply corrugated fiberboard or tearable material. The overlapping portions 54, 56, 58, 60 of the box 10 used to secure the different panels together are not found on the bottom panel 14 but are on the side panels, 16, 20 of the box 10. It is preferred that the tear tape 34 (FIG. 2) be applied to a single-ply panel such as the bottom panel 14 as opposed to a side panel 18, 22 (FIG. 10) that has double-ply segments thereon.

Figure 11:
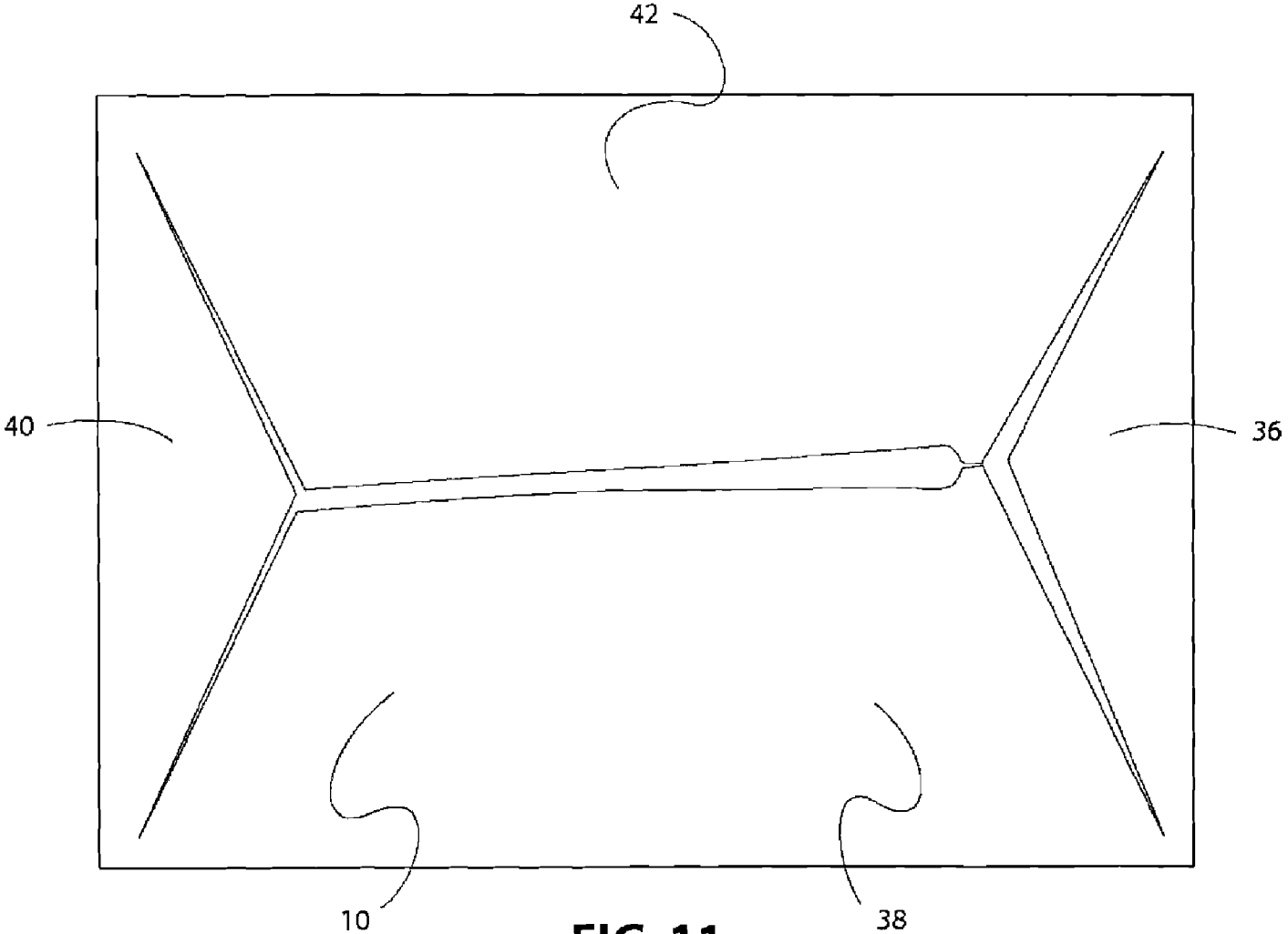
FIG. 11 is an exterior view of the bottom of the box with the flaps detached but in the closed position.

Directing attention to FIG. 11, another advantage of the subject invention resides in the fact that the flaps 36, 38, 40, 42 are still intact and may be closed so that although somewhat weaker, the box 10 generally retains its original shape. By retaining the option of returning the box 10 to its original shape, it is possible for the user to return to the box 10 packing material and other residual material that arrived with the product and to return the flaps 36, 38, 40, 42 to their original position thereby providing at least a partial enclosure for the residual material.

Although not illustrated in the embodiments herein, it may be possible to substitute for one or more of the perforations 24, 26, 28, 30 tear tapes similar to the tear tape 32 such that one of more flaps may be severed using the tear tape as opposed to the perforations.

The tear tape 32 must have tensile strength sufficient to tear the panel and may have adhesive on one side to be secured to the panel. It is also possible in lieu of such tear tape, to utilize a wire with an adhesive tape used to secure the wire to the panel, such that it is the tensile strength of the wire that is utilized to tear the panel. In a preferred embodiment, the tear tape is #220 TPP heavy duty tensilized strapping tape with clean removal rubber based adhesive. Such tape is provided by the TaraTape Company in Fairless Hills, Pa.

While a rectangular box has been illustrated herein, the subject invention may be utilized in a box having any shape with a surface sufficient to accept a tear tape and associated perforations for flap opening.

Directing attention to FIG. 2, the tear tape 34 may be manually applied to the internal surface of the bottom panel 14 and to assist in properly positioning the tear tape 34 on the bottom panel, a pair of locating marks 52, in the form of puncture lines, may be provided. These puncture lines 52 are not perforations, but are only shallow punctures in the surface of the bottom panel to assist in placement of the tear tape 34.

It should also be noted that the shape of the flaps 36, 38, 40, 42, while applicable to the bottom panel 14, may be modified for a more desirable pattern or may be modified in the event the shape of the bottom panel is different from that illustrated herein.

FIG. 12 illustrates the box in the opened position.

Figure 13:
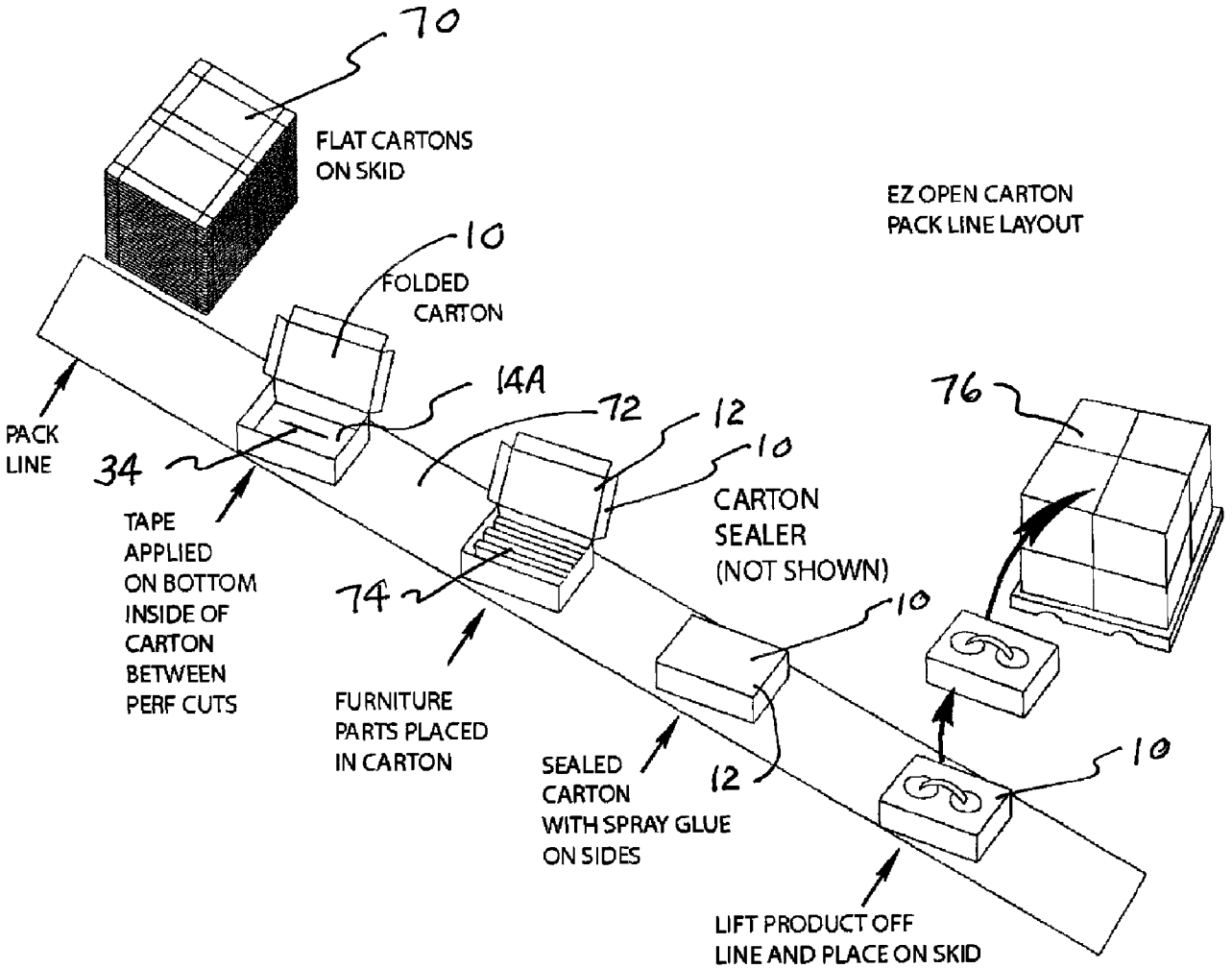
FIG. 13 is a sketch illustrating the steps for assembling the box and packaging contents within the box.

FIG. 13 illustrates the manner in which a box 10 is assembled and populated with contents. A plurality of unassembled boxes 10, in the form of flat cartons 70 are positioned along a moving packing line 72. Each flat carton 70 has already been processed to impart therein at the appropriate locations, the perforations 54, 56, 58, 60 (FIG. 1), the finger hole 44 and the puncture lines 52 (FIG. 2). A flat carton 70 is folded and the overlapping portions 54, 56, 58, 60 (FIG. 2) are glued or stapled to the respective side panel 18, 22 (FIG. 2) to form a box 10. The tear tape 34 is applied to the interior surface 15B of the box 10, using, as a visual guide, the puncture lines 52 (FIG. 2). The box 10 is then populated with, for example, furniture panels 74 used as components for ready-to-assemble furniture.

The top panel 12 is then glued or stapled to the respective side panels to form a sealed box 10. Thereafter, the sealed box 10 is removed from the packing line 72 and positioned onto a skid 76 for transporting to a location.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

I claim:

1. A box with foldable flaps for easy opening, wherein the box is comprised of:

a top panel;

a bottom panel;

side panels connecting the top panel to the bottom panel;

wherein one of the-top panel and bottom panel comprises:

a tear strip having a first end, a second end and opposing edges there between, and wherein the tear strip is secured to the panel;

a first flap and a second flap defined on opposing sides of the tear strip, wherein each of the first flap and the second flap has an outer edge connected to a side panel and an inner edge defined at an edge of the tear strip;

wherein each flap has a pair of opposing lateral edges between the outer edge and the inner edge and wherein each of the opposing lateral edges has perforations extending along substantially the entire length, and wherein each perforation extends substantially through the thickness of the flap;

wherein pulling the tear strip creates a gap between the first flap and the second flap and provides access for pulling the inner edges of the flaps such that the flap lateral edges may be torn along the perforations with relative ease to provide access to the interior of the box; and wherein the panel between the inner edge of the first flap and the inner edge of the second flap is not perforated along a substantial length between the first end and the second end of the tear strip.

2. The box in accordance with claim 1, wherein the tear strip is comprised of a tensile member from the group of a tear tape and tear wire.

3. The box in accordance with claim 2, wherein the tensile member is secured to the interior surface of the panel.

4. The box in accordance with claim 1, wherein the lateral edges of opposing flaps are adjacent to one another and form a v-shape.

5. The box in accordance with claim 1, wherein the perforations extend only through the lateral edges of the flaps and through the panel in the region adjacent to the first end of the tear strip.

6. The box in accordance with claim 1, wherein at least a portion of the region where the tear strip is intended to be placed has locating marks.

7. The box in accordance with claim 6, wherein the locating marks are puncture lines extending only partially through the panel.

8. The box in accordance with claim 1, wherein the tear strip is located midway between the sides of the box.

9. The box in accordance with claim 1, further including a finger hole adjacent to the first end of the tear strip.

10. The box in accordance with claim 1, further including a cut out staffer tab at the first end of the tear strip.

11. The box in accordance with claim 1, wherein the box is generally rectangular with four sides.

12. The box in accordance with claim 1, further including wood panels within the box.

13. A method of opening a box having a top panel, a bottom panel, and side panels connecting the top panel to the bottom panel, wherein one of the top panel and bottom panel has a tear strip having a first end, a second end and opposing edges there between, wherein the tear strip is secured to the panel, a first flap and a second flap defined on opposing sides of the tear strip, and wherein each of the first flap and the second flap has an outer edge connected to a side panel and an inner edge defined at an edge of the tear strip, and wherein each flap has a pair of opposing lateral edges between the outer edge and the inner edge, wherein each of the opposing lateral edges has perforations extending along substantially the entire length, wherein the panel between the inner edge of the first flap and the inner edge of the second flap is not perforated along a substantial length between the first end and the second end of the tear strip, and wherein each perforation extends substantially through the thickness of the flap, the method comprising the steps of:

a) pulling the tear strip to creates a gap between the first flap and the second flap, b) pulling the inner edge of one flap to sever the flap along the perforation, and c) pulling the inner edge of the opposing flap the sever the flap along the perforation, thereby providing access to the interior of the box.

14. A box with foldable flaps for easy opening, wherein the box is comprised of:

a top panel;

a bottom panel;

side panels connecting the top panel to the bottom panel;

wherein one of the top panel and bottom panel comprises:

a tear strip having a first end, a second end and opposing edges there between, and wherein the tear strip is secured to the panel;

a first flap and a second flap defined on opposing sides of the tear strip, wherein each of the first flap and the second flap has an outer edge connected to a side panel and an inner edge defined at an edge of the tear strip;

wherein each flap has a pair of opposing lateral edges between the outer edge and the inner edge and wherein each of the opposing lateral edges has perforations extending along substantially the entire length, and wherein each perforation extends substantially through the thickness of the flap;

wherein pulling the tear strip creates a gap between the first flap and the second flap and provides access for pulling the inner edges of the flaps such that the flap perforations may be torn along the perforations with relative ease to provide access to the interior of the box;

wherein at least a portion of the region where the tear strip is intended to be placed has locating marks; and wherein the locating marks are puncture lines extending only partially through the panel.

* * * * *